United States Patent [19]

Murakami

[11] Patent Number: 4,708,502

[45] Date of Patent: Nov. 24, 1987

[54] MOUNTING MECHANISM FOR A PRINT HEAD

[75] Inventor: Kenjiro Murakami, Suwa, Japan

[73] Assignee: Seiko Espon Kabushiki Kaisha, Japan

[21] Appl. No.: 843,355

[22] Filed: Mar. 24, 1986

[30] Foreign Application Priority Data

Mar. 26, 1985 [JP] Japan ..... 60-61467

[51] Int. Cl.[4] ..... B41J 1/60

[52] U.S. Cl. ..... 400/175; 400/124; 400/320

[58] Field of Search ..... 400/174, 175, 124, 320

[56] References Cited

U.S. PATENT DOCUMENTS

| | | | |
|---|---|---|---|
| 4,410,288 | 10/1983 | Holmes, Jr. | 400/175 X |
| 4,555,715 | 11/1985 | Vegeais et al. | 400/320 X |
| 4,576,494 | 3/1986 | Smith | 400/175 |
| 4,576,496 | 3/1986 | Schwarz et al. | 400/320 X |

FOREIGN PATENT DOCUMENTS

| | | | |
|---|---|---|---|
| 48311 | 3/1982 | European Pat. Off. | 400/320 |
| 104781 | 6/1983 | Japan | 400/175 |
| 222375 | 12/1984 | Japan | 400/175 |
| 224380 | 12/1984 | Japan | 400/175 |
| 1316766 | of 0000 | United Kingdom . | |
| 809472 | of 0000 | United Kingdom . | |
| 1060533 | of 0000 | United Kingdom . | |

OTHER PUBLICATIONS

IBM Tech. Disc. Bulletin, "Self-Centering Disk Clamp", Bosier et al., vol. 26, No. 12, May 1984, p. 6632.

*Primary Examiner*—Charles A. Pearson
*Assistant Examiner*—James R. McDaniel
*Attorney, Agent, or Firm*—Blum Kaplan

[57] ABSTRACT

A mounting mechanism for releaseably mounting a print head to the carriage of a printer includes a pair of pivotable levers respectively located on opposite sides of the print head. A spring member biases the levers in a predetermined direction. The levers are pivotable between a first position where the print head is secured to the carriage and a second position where the print head is released.

11 Claims, 6 Drawing Figures

MOUNTING MECHANISM FOR A PRINT HEAD

BACKGROUND OF THE INVENTION

The present invention is directed to a mounting mechanism for a print head and, in particular, to a mounting mechanism which permits the print head to be easily removed from the printer carriage.

In a printing apparatus making use of a print head, the print head needs to be removed and replaced during the assembly of the printing apparatus, when repairs must be made to the printing apparatus, and at the end of the useful life of the print head. Reference is made to FIG. 5 of the drawings which depicts a conventional mounting mechanism for a print head. A print head 31 is secured to a carriage 32 which acts as a mount for the print head by means of screws 33*a* and 33*b*. Whenever print head 31 needs to be removed as noted above, print head 31 has to be removed from and remounted on carriage 32 by rotating screws 33*a* and 33*b* with a special tool such as a screwdriver. Therefore, prior art mounting mechanisms suffer the disadvantage in that, in order to remove and remount print head 31, an operator requires a special tool such as a screwdriver and is forced not only to perform complicated removal actions but also to spend a considerable period of time doing so. Other examples of prior art mounting mechanisms for print heads are disclosed in U.S. Pat. No. 4,452,542 and U.S. Pat. No. 4,514,100.

Accordingly, it is desirable to provide a mounting mechanism for a print head which allows easy and quick removal and replacement of the print head.

SUMMARY OF THE INVENTION

Generally speaking, in accordance with the present invention, a mounting mechanism for a print head is provided for easy and quick removal and replacement of print heads without the need of any special tools. The mounting mechanism includes a pair of levers respectively located on opposite sides of the print head on a printer carriage which are pivotably supported on the carriage by means of a spring member which biases the levers in a predetermined direction. The first and second levers are pivotable between a first position where the print head is locked to the carriage and a second position where the print head can be removed.

Accordingly, it is an object of the present invention to provide an improved mounting mechanism for a print head.

Another object of the present invention is to provide a mounting mechanism for a print head which allows the easy removal and replacement of a print head without the use of special tools.

A further object of the present invention is to provide an improved mounting mechanism for a print head which allows for the removal and replacement of the print head without many time consuming complicated actions.

Still other objects and advantages of the invention will in part be obvious and in part will be apparent from the specification and drawings.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1(*b*) is a front elevational view of the mounting mechanism for a print head depicted in FIG. 1(*a*) where the print head is shown unsecured;

DESCRIPTION OF THE PREFERRED EMBODIMENTS

Figure 1A:
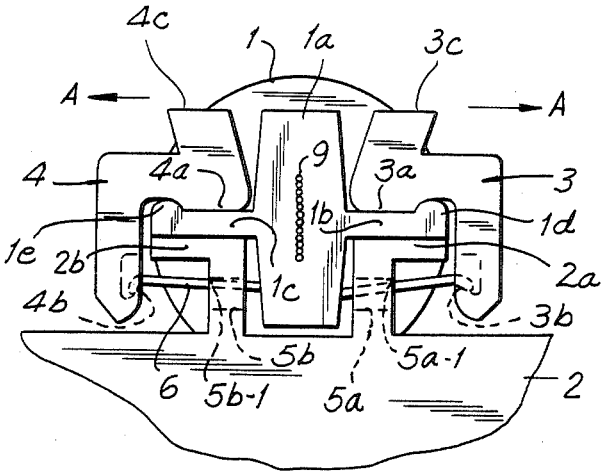
FIG. 1(*a*) is a front elevational view of a mounting mechanism for a print head in which a print head is secured on a printer carriage, constructed in accordance with a first embodiment of the present invention.
Figure 1B:
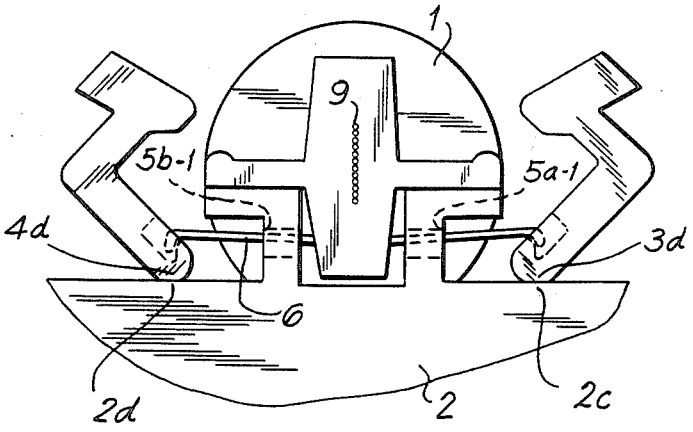
Figure 2:
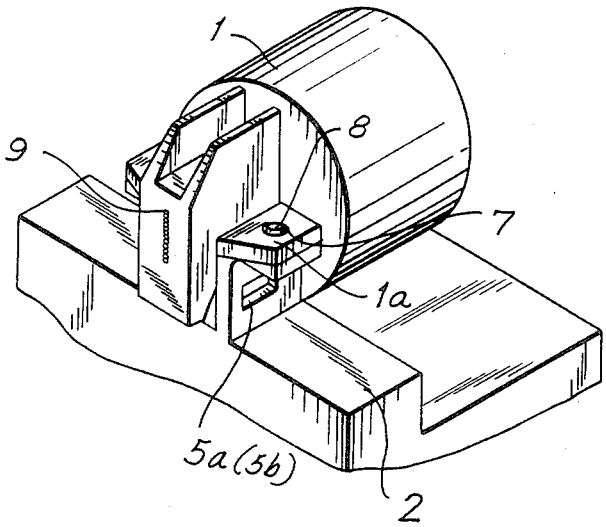
FIG. 2 is a perspective view of a mounting mechanism for a print head shown with the print head in place, but with the levers and spring of the mounting mechanism omitted for purposes of explanation.
Figure 3:
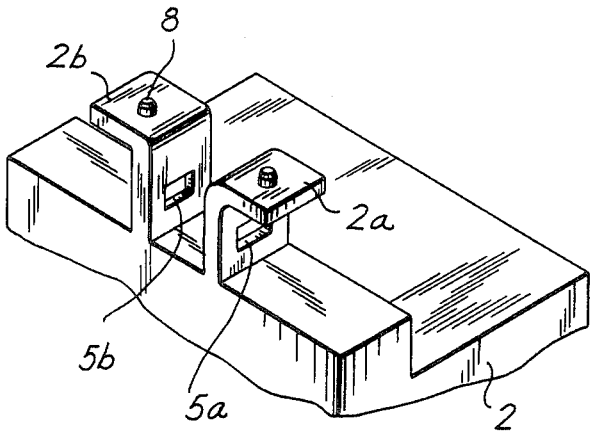
FIG. 3 is a perspective view of the mounting mechanism for a print head as depicted in FIG. 2 wherein the print head is shown removed from the printer carriage.

Reference is first made to FIGS. 1(*a*) and 1(*b*), 2 and 3 which depict a print head 1 which prints by utilizing the impact of a set of print wires 9. Print head 1 includes a nose portion 1*a* with flat regions or legs 1*b* and 1*c* extending respectively on each side of nose 1*a*. Flat regions 1*b* and 1*c* each have a convex projection 1*d* and 1*e* formed respectively on the top surfaces thereof.

A carriage 2 having flat regions or legs 2*a* and 2*b* rigidly affixed to carriage 2 by means of a U-shaped support acts as a mount for print head 1. A single upwardly extending pin 8 is provided on each flat region 2*a* and 2*b*. Corresponding openings 7 are formed in each flat region 1*b* and 1*c* of print head 1. Print head 1 is positioned on carriage 2 such that pins 8 extend through openings 7 thereby allowing print head 1 to lie flush against flat regions 2*a* and 2*b* in such a manner that print head 1 is supported and properly positioned on flat regions 2*a* and 2*b* of carriage 2. The cooperation between openings 7 and pins 8 determine the relative position of carriage 2 with respect to print head 1.

Levers 3 and 4 are rotatably coupled to carriage 2 and are of the same shape. Levers 3 and 4 include grip portions 3*c* and 4*c*, respectively, at the upper end thereof for manual operation of levers 3 and 4. Directly below grip portions 3*c* and 4*c* are pressing portions 3*a* and 4*a* respectively, which engage flat regions 1*b* and 1*c*, respectively, of print head 1. Both levers also include a flat surface 3*d* and 4*d*, respectively formed at a 45° angle as depicted. Levers 3 and 4 are arranged so that flat portions 3*d* and 4*d* come into contact with respective flat surfaces 2*c* and 2*d* on carriage 2 after each lever has rotated 45° from the position in which it is engaged with print head 1 to a position in which it comes in contact with surfaces 2*c* and 2*d*.

Engagement slots 3*b* and 4*b* are respectively formed in levers 3 and 4 and are engaged with the two ends of a leaf spring 6. Leaf spring 6 passes through openings 5*a* and 5*b* in carriage 2 located in the U-shaped support. Leaf spring 6 is bent in such a manner that its ends are respectively engaged with engagement slots 3*b* and 4*b*. Engagement slots 3*b* and 4*b* are positioned above openings 5*a* and 5*b* so that when engaged with leaf spring 6, leaf spring 6 is deflected upwards.

When print head 1 is secured, leaf spring 6 is deflected upward against upper surfaces 5*a*-1 and 5*b*-1 of openings 5*a* and 5*b*, respectively. Openings 5*a* and 5*b* act as fulcrums which cause leaf spring 6 to apply a downward force to levers 3 and 4. This, in turn, causes pressing portions 3*a* and 4*a* of levers 3 and 4 to engage flat regions 1*b* and 1*c* of print head 1 and press flat portions 1*b* and 1*c* against flat portions 2*a* and 2*b* of carriage 2. The resultant force of leaf spring 6 acting on levers 3 and 4 is a force in the direction of arrow A. Convex projections 1*d* and 1*e* of print head 1 exert a force with respect to levers 3 and 4 which acts to overcome the force in the direction of arrow A. Therefore, levers 3 and 4 are held securely in position.

In order to release print head 1, grip portions 3*c* and 4*c* of levers 3 and 4 are pressed manually in the direction of arrow A, with a force sufficient to cause lever 3 and 4 to pass over convex projections 1*d* and 1*e*. Engagement portions 3*b* and 4*b* remain engaged with leaf spring 6 and act as a second set of fulcrums as levers 3 and 4 rotate. The levers rotate through 45°, after which flat surfaces 3*d* and 4*d* come into contact with flat portions 2*c* and 2*d* of carriage 2 thereby preventing any further rotation. In this condition, the degree of upward deflection of leaf spring 6 has decreased, but spring 6 is still deflected upward. Therefore, a downward force is still exerted on levers 3 and 4. This secures levers 3 and 4 by pinning them against flat regions 2*c* and 2*d*. Levers 3 and 4 are now spread far enough apart to allow clearance for the removal of print head 1.

Since print head 1 is held on carriage 2 by its own weight when levers 3 and 4 are rotated, it can easily be removed off of the carriage. To remount and resecure print head 1, levers 3 and 4 are operated in reverse order, that is, a manual force sufficient to cause levers 3 and 4 to pass over the convex projections 1*d* and 1*e* in the reverse direction is applied to grip portions 3*c* and 4*c*.

Figure 4:
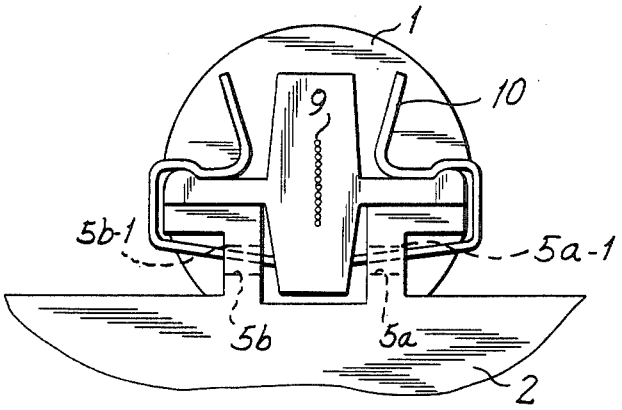
FIG. 4 is a front elevational view of a mounting mechanism for a print head constructed in accordance with an alternative embodiment of the present invention.
Figure 5:
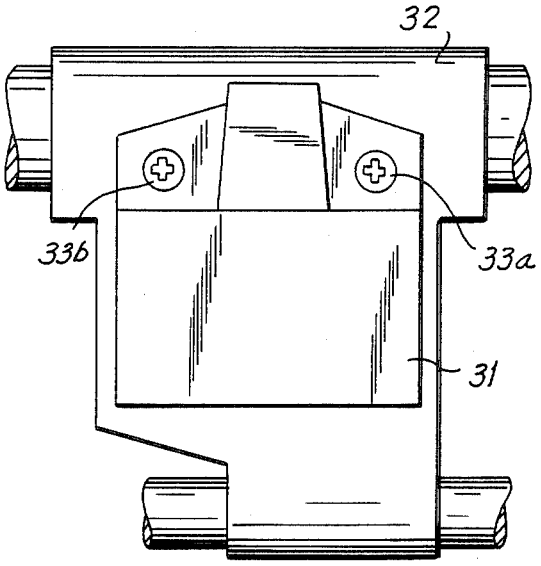
FIG. 5 PRIOR ART
FIG. 5 is a top plan view depicting a mounting mechansim for a print head constructed in accordance with the prior art.

Referring now to FIG. 4, another embodiment of the present invention is shown for a mounting mechanism for a print head wherein the leaf spring and the levers are integrally formed. A lever 10 is formed of a single integral material having the resiliency of a spring. The upper portions of lever 10 engage print head 1 as described above in connection with the first embodiment. Spring lever 10 is curved upward at its bottom region so that opening edges 5*a*-1 and 5*b*-1 still act as a fulcrum enabling spring lever 10 to exert a downward force on print head 1. Print head 1 is removed from carriage 2 with one touch of a finger in the same manner as described above in the first embodiment.

It is noted that print head 1 may be an impact print head of the wire dot type, a thermal print head, a matrix type print head or any other type of print head. Also, the rotational angle of each of levers 3 and 4 can be changed by altering the angle at which the flat surfaces 3*d* and 4*d* are formed, whereby levers 3 and 4 can be rotated until they stop at the desired angle.

Accordingly, by providing a mounting mechanism for a print head as described above, the problems in removing print heads encountered with prior art mounting mechanisms are overcome. The present invention provides a simple and inexpensively constructed mounting mechanism which achieves each of the objects noted above. No special tools are required for print head removal. Quick and easy print head removal can be effected with the present invention.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limting sense.

It is also to be understood that the following claims are intended to cover all of the generic and specific features of the invention herein described, and all statements of the scope of the invention which, as a matter of language, might be said to fall therebetween.

What is claimed is:

1. A mounting mechanism for mounting a print head on a carriage of a printer comprising positioning means coupled to said carriage for positioning said print head thereon, engagement means on said print head for releaseably engaging with said positioning means to position said print head on said carriage, first and second lever means pivotably coupled to said carriage on opposite sides of said print head for releaseably locking said print head to said carriage and pivotable between a first position where said print head is locked to said carriage and a second position where said print head is released, said print head being positioned intermediate said first and second lever means, and biasing means for biasing said first and second lever means in a closed position when said first and second lever means are pivoted to said first position to press said print head against said carriage and in an open position when said first and second lever means are pivoted to said second position, said biasing means including spring means supported on said carriage and extending to engage with said first and second lever means, said first lever means including a first slot and said second lever means including a second slot, said spring means extending into said first and second slots in said first and second lever means, respectively, to hold said first and second lever means on said carriage, said spring means serving to bias said first and second lever means when in said first position so as to urge said first and second lever means to remain in said first position and likewise, to bias said first and second lever means when in said second position so as to urge said first and second lever means to remain in said second position.

2. The mounting mechanism as claimed in claim 1, wherein said carriage includes an extension having first and second legs which extend essentially parallel to said carriage respectively from the ends of said extension, said first and second legs including a first and second pin respectively extending therefrom which form said positioning means, said print head including third and fourth legs which extend outwardly therefrom on opposite sides of said print head, said engagement means including first and second openings on said third and fourth legs respectively through which said first and second pins extend.

3. The mounting mechanism as claimed in claim 2, wherein said extension includes third and fourth openings therein, said spring means extending through said third and fourth openings.

4. The mounting mechansim as claimed in claim 3, wherein said third and fourth legs of said print head include first and second convex portions, respectively, said first lever means including a first recessed portion into which said first convex portion extends, and said second lever means including a second recessed portion into which said second convex portion extends to releaseably lock said first and second lever means to said print head.

5. The mounting mechansim as claimed in claim 4, wherein said first lever means includes a first flat surface and said second lever means includes a second flat surface, said first and second flat surfaces engaging with said carriage to hold said first and second lever means in said second position.

6. The mounting mechanism as claimed in claim 5, wherein said spring means biases said first and second lever means in the direction of said second position.

7. The mounting mechanism as claimed in claim 3, wherein said spring means is a leaf spring.

8. The mounting mechanism as claimed in claim 1, wherein said carriage includes first and second openings, said spring means extending through said first and second openings.

9. The mounting mechanism as claimed in claim 8, wherein said carriage includes first and second raised platforms extending essentially parallel to the surface of said carriage, said print head including first and second legs which rest on said first and second raised platforms, respectively, said first lever means locking said first leg to said first platform, and said second lever means locking said second leg to said second platform when said first and second lever means are in their first position.

10. The mounting mechanism as claimed in claim 9, wherein said first lever means includes a first flat surface and said second lever means includes a second flat surface, said first and second flat surfaces engaging with said carriage to hold said first and second lever means in said second position.

11. The mounting mechanism as claimed in claim 1, wherein said spring means is a leaf spring.

* * * * *